United States Patent [19]

Nakayama

[11] Patent Number: 4,712,378

[45] Date of Patent: Dec. 15, 1987

[54] DRIVING APPARATUS FOR STIRLING CYCLE ENGINE

[75] Inventor: Kouichi Nakayama, Kariya, Japan

[73] Assignee: Aisin Seiki Kabushiki Kaisha, Kariya, Japan

[21] Appl. No.: 844,936

[22] Filed: Mar. 27, 1986

[30] Foreign Application Priority Data

Mar. 29, 1985 [JP] Japan ..... 60-67637

[51] Int. Cl.[4] ..... F02G 1/04

[52] U.S. Cl. ..... 60/525; 60/517

[58] Field of Search ..... 60/517, 525

[56] References Cited

U.S. PATENT DOCUMENTS 3,200,582 8/1965 Dros ..... 60/525

*Primary Examiner*—Allen M. Ostrager

*Attorney, Agent, or Firm*—Burns, Doane, Swecker & Mathis

[57] ABSTRACT

A driving apparatus for a Stirling cycle engine is disclosed. The engine has a diaphragm on a rod connecting each compression piston and a driving mechanism. The diaphragm separates a space of the compression piston back pressure side and a driving chamber. A crank axle has at least one crank pin with two compression pistons connected to the crank pin of the crank axle. The pistons are located on opposite sides of the crank axle. The diaphragms of the two compression pistons perform the capacity change of the piston back pressure sides 180° out of phase relative to one another.

7 Claims, 6 Drawing Figures

FIG. 1
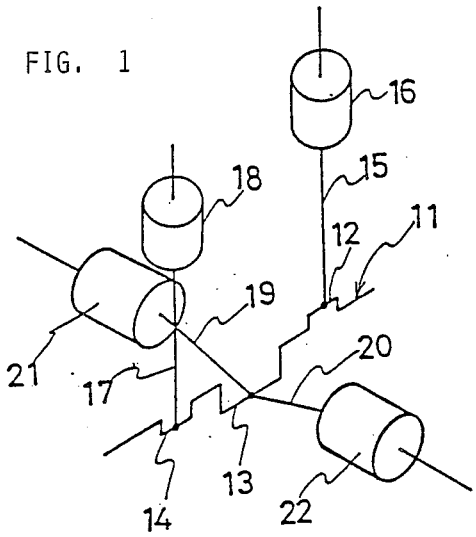
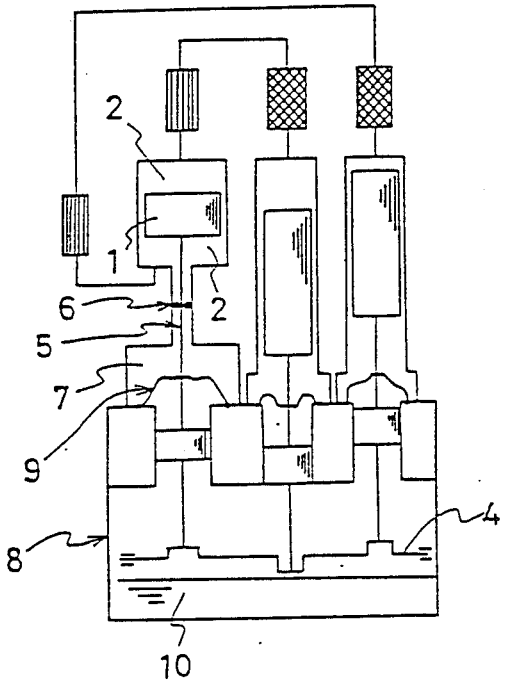
FIG. 5
PRIOR ART

DRIVING APPARATUS FOR STIRLING CYCLE ENGINE

BACKGROUND OF THE INVENTION

1. Field of the Invention

This invention generally relates to a Stirling cycle engine, and more particularly, to a driving apparatus for a Stirling cycle engine.

2. Description of the Prior Art

In conventional Stirling cycle engine systems there are various kinds of actuating gas circuits having an expansion space, a compression space, a regenerator and a heat radiator. The actuating gas circuits may be comprised of just one circuit or a combination of a plurality of circuits.

The construction by one actuating gas circuit is disclosed in Japanese Patent Publication No. 47(1972)-44580. In this system, the torque change is large so that vibration, noise and durability become matters of concern. The construction by a combination of a plurality of circuits is disclosed in Japanese Patent Publication No. 51(1976)-10310. Many parts are required for this construction so that the manufacturing cost becomes high.

Further, there is the Japanese Laid-Open Patent Application No. 54(1979)-12062 in which the actuating gas circuit is constructed by two circuits in a manner similar to the present invention. A diaphragm 9 is provided on a rod 5 for preventing the oil flux in this construction as shown in FIG. 5. A crank axle 4 has three branches so that the construction becomes simple. The operating point of the load on the crank axle 4 by a piston 1 is one point, so the change of the bending moment of the crank axle 4 is little and the vibration is decreased. However, a seal member 6 is required on the rod 5 of the piston 1 in this construction. The function of the seal member 6 is important.

If the actuating gas from a compression space in an upper space 7 of the diaphragm 9 leaks, the compression ratio within the actuating gas circuit is decreased and the output force is decreased. Besides these disadvantages, the pressure in the upper space 7 of the diaphragm 9 is increased due to the presence of the seal member 6 and the pressure difference between the upper space 7 of the diaphragm 9 and the pressure within a crankcase 8 becomes large thereby adding to the possibility for leakage of the actuating gas. As a result, the diaphragm 9 comes off or is damaged and the oil 10 within the crankcase 8 rises up within the actuating gas circuit and output power is lowered. Further, as the capacity of the upper space 7 of the diaphragm 9 is changed due to the up and down movement (reciprocating movement) of the rod 5, the pressure is constantly changing and the diaphragm may come off or be damaged.

It is a possibility to provide a surge tank (not shown in FIG. 5) communicating with the upper space 7 of the diaphragm 9 for minimizing the above-mentioned drawbacks. However, in this case, the surge tank must have an extremely large capacity for sufficiently minimizing the pressure change.

SUMMARY OF THE PRESENT INVENTION

It is, therefore, an object of the present invention to provide an improved driving apparatus for a Stirling cycle engine.

It is another object of the invention to obviate the above-mentioned drawbacks of conventional Stirling cycle engine driving apparatus.

According to the present invention in a Stirling cycle engine having a diaphragm for separating a space of the back pressure side of a compression piston and a driving chamber and provided on a rod connecting a compression piston and a driving mechanism, two compression pistons are arranged on opposite sides of a crank axle at a position 180° out of phase relative to one another and one crank pin is engaged therewith and the capacity change of an upper portion of the two diaphragms operate 180° out of phase relative to one another.

Accordingly, in the case of a Stirling cycle engine constructed with a crank axle having three branches, the conventional seal member which is required as shown in FIG. 5 is not required in the present invention. The capacity change of the compression piston is performed by the phase difference of 180° between the two pistons arranged on opposite sides of the crank axle. Further, a communicating passage for communicating the back pressure space of the compression pistons is provided so that the pressure change within the back pressure space of the compression pistons is removed. As a result, the diaphragm doesn't come off and is not damaged.

BRIEF DESCRIPTION OF THE DRAWINGS

The above and other objects and features of the present invention will become apparent from the following description with reference to the attached drawings of the preferred embodiments wherein, like members bear like reference numerals and wherein:

FIG. 1 is a schematic perspective view of a driving portion of a driving apparatus for a Stirling engine according to the present invention.

FIG. 5 is a schematic view of a circuit of a driving apparatus according to a conventional Stirling engine.

DETAILED DESCRIPTION OF THE PREFERRED EMBODIMENT

Figure 2A:
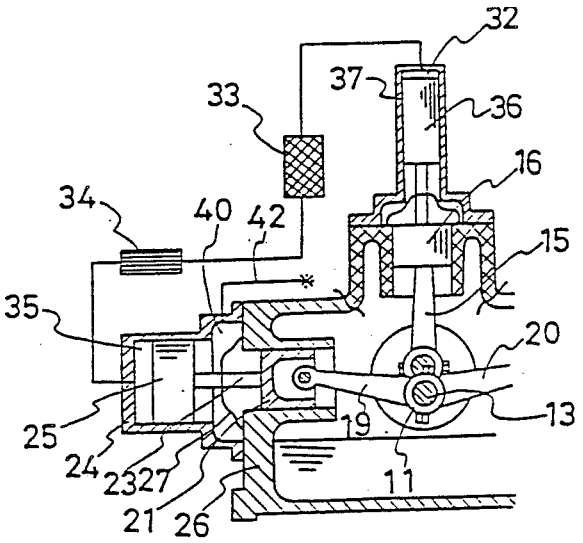
FIG. 2*a* is a cross-sectional view of the left side portion of the driving portion in FIG. 1.

Referring now to the drawings, particularly to FIG. 1, a crank axle 11 is provided with crank pins 13, 14 which are located 180° out of phase relative to a crank pin 12. A guide piston 16 is engaged with the crank pin 12 and is movable in the vertical direction through a connecting rod 15. Similarly, a guide piston 18 is engaged with the crank pin 14 through a connecting rod 17. Guide pistons 21, 22 are engaged with the crank pin 13 and are horizontally movable through connecting rods 19, 20 and are arranged on opposite sides of the crank axle 11.

Figure 2B:
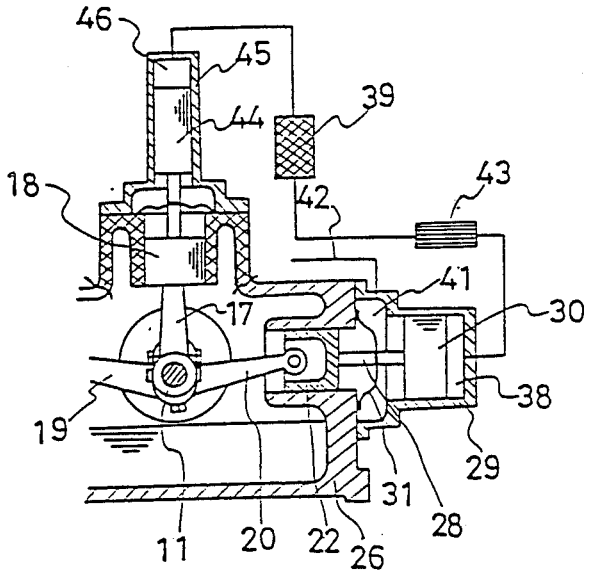
FIG. 2*b* is a cross-sectional view of the right side portion of the driving portion in FIG. 1.

With reference to FIGS. 2*a* and 2*b*, a Stirling engine includes the crank axle 11 and the guide pistons 16, 18 of FIG. 1. In FIG. 2*a*, a compression piston 25 is arranged within a cylinder 24 and is connected to a rod 23 which is connected to the guide piston 21. A diaphragm 27 is connected to a crankcase 26 at the circumference thereof and is connected to the rod 23. A compression space 35 formed by the compression piston 25 and the cylinder 24 is communicated with an expansion space 32 through a heat radiator 34 and a regenerator 33. The expansion space 32 is formed by a piston 36 and a cylinder 37.

With reference to FIG. 2*b*, a compression piston 30 within a cylinder 29 is connected to a rod 28 which is connected to the guide piston 22. A diaphragm 31 is connected to the crankcase 26 and is connected to the rod 28 at the inner circumferential portion thereof. A compression space 38 formed by the compression piston 30 and the cylinder 29 is communicated with an expansion space 46 through a heat radiator 43 and a cold regenerator 39.

The capacity of the compression space 35 and the expansion space 32 is changed by the phase difference occasioned by the right-angled orientation of the connecting rods 15, 19 in accordance with the rotation of the crank axle 11. Similarly, the capacity of the compression space 38 and the expansion space 46 is changed also by the phase difference occasioned by the right-angled orientation of the connecting rods 17, 20 in accordance with the rotation of the crank axle 11. Accordingly, the crank axle 11 having three branches is utilized and a seal member is not required at the rod portion, so that a Stirling motor comprised of two circuits is obtained. Also, the capacity of spaces 40, 41 of the compression piston back pressure side is changed by the phase difference of the oppositely moving pistons 21 and 22 so that the pressure change of the spaces 40, 41 of the compression piston back pressure side may be removed by providing a communicating passage 42. As a result, the diaphragms 27, 31 are not subjected to large pressure differentials and hence, do not come off and are not damaged.

Figure 3:
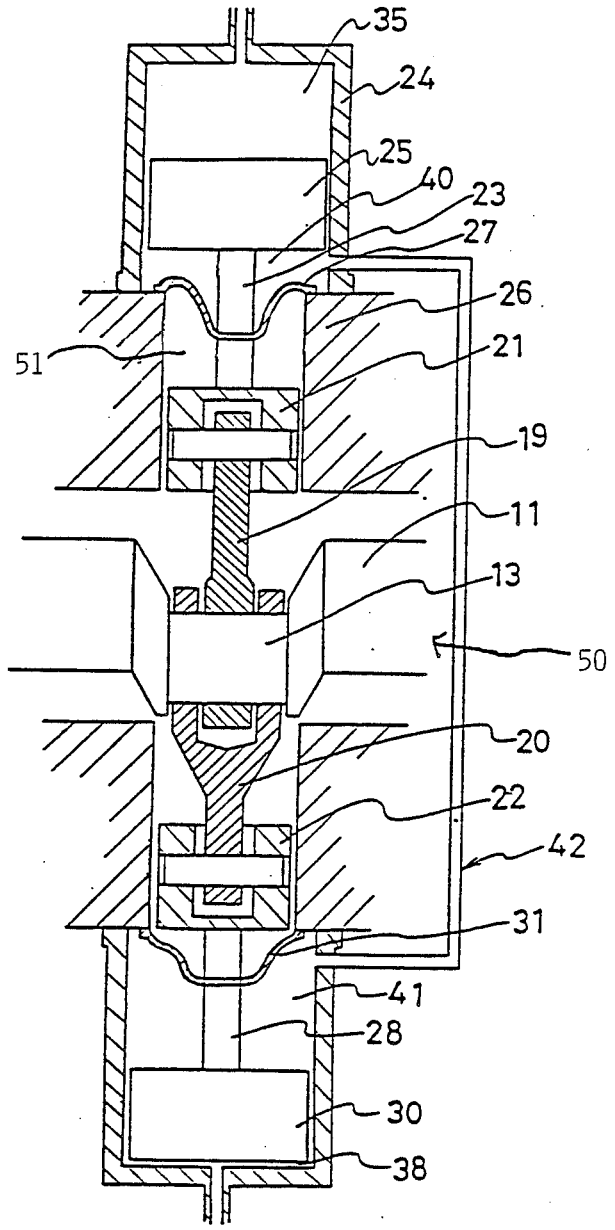
FIG. 3 is an enlarged cross-sectional view of the locating relationship in FIG. 1.

With reference to FIG. 3, the location of the crank axle 11 and the compression pistons 25, 30 is shown. The compression pistons 25, 30 are arranged on a straight line which intersects at right angles with a central line of the crank axle 11. The compression piston 25 is connected to the crank pin 13 through the rod 23, the guide piston 21, and the connecting rod 19. The compression piston 30 is connected also to the crank pin 13 through the rod 28, the guide piston 22 and the connecting rod 20. Since the operating point of the load from each connecting rod 19, 20 onto the compression pistons 25, 30 is the same point, the change of the bending movement acted on the crank axle 11 is little and vibration can be minimized.

Figure 4:
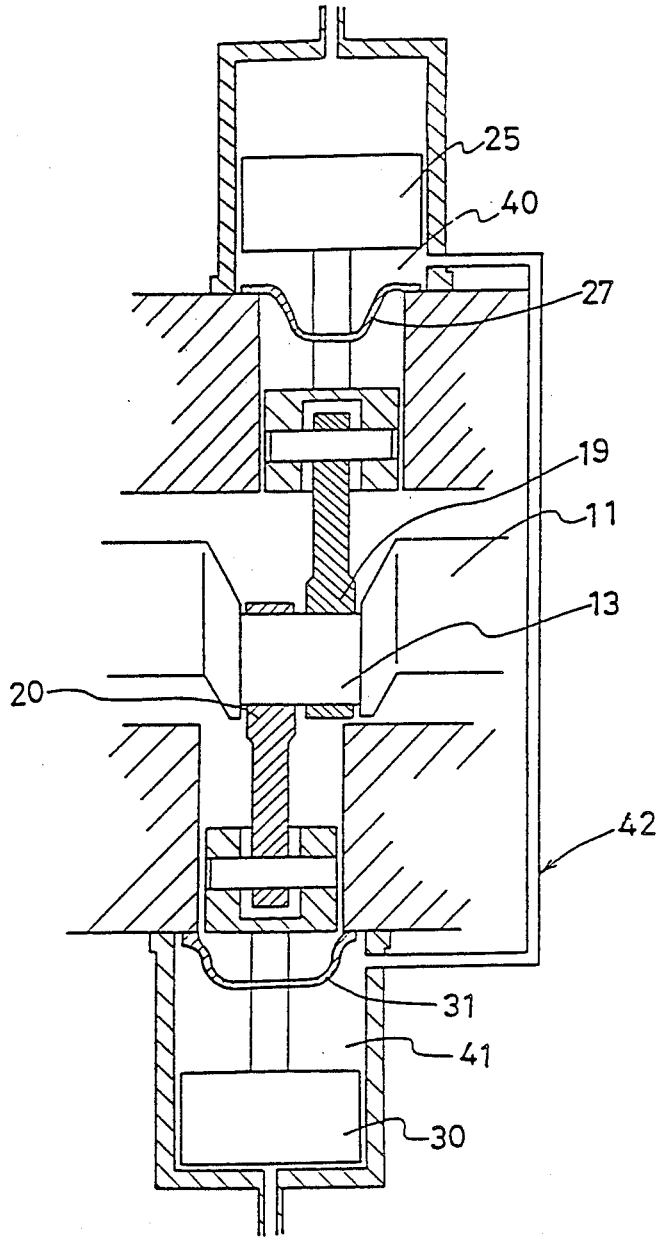
FIG. 4 is an enlarged cross-sectional view of a modification of FIG. 3.

With reference to FIG. 4, the central line of the compression pistons 25, 30 is parallel and the compression pistons 25, 30 are connected to the crank pin 13 as in FIG. 2. The operating point of the load from each connecting rod 19, 20 onto the compression pistons 25, 30 becomes slightly shifted, but connecting rods 19, 20 having the same shape can be used. As shown in FIGS. 3 and 4, the capacity change of the compression pistons 25, 30 are performed 180° out of phase, i.e., by oppositely directed movements of the pistons 25, 30, and the communicating passage 42 is provided for communicating the spaces 40, 41 of the compression piston back pressure sides, so that the pressure change of these spaces can be removed. As a result, the diaphragms 27, 31 do not come off and are not damaged. Furthermore, the volumetric capacity change of the upper portions of each diaphragm 27, 31 can be absorbed by the opposite phase, so that a big surge tank is not required, because the communicating passage is provided to continuously remove the pressure. Accordingly, the pressure change of the spaces of the upper portion of the diaphragms 27, 31 is completely removed.

The compression pistons 25, 30 are arranged at opposite sides of the crank axle 11, so that each actuating gas circuit can be designed with the same shape and the specification of many portions become the same. As a result, the manufacturing cost can be decreased.

With the present invention, two compression pistons 25, 30 are separately arranged on opposite sides of the crank axle 11 to be 180° out of phase relative to each other and are each connected to one crank pin 13. The conventional seal member 6 as shown in FIG. 5 and required upon constructing the Stirling engine with a crank axle having three branches is not required in the present invention.

Although the invention is described with reference to a particular embodiment thereof, it is to be understood that the invention is not limited to the particular embodiment disclosed but is capable of various other embodiments within the scope of the appended claims.

What is claimed is:

1. In a Stirling engine, a driving apparatus comprising:

at least two compression pistons;

a driving mechanims for each compression piston;

a rod interconnecting each compression piston with its respective driving mechanism;

a diaphragm on each rod closing off a space of the compression piston back pressure side and permitting a change in the volumetric capacity of the space, means for releasing pressure from the spaces of the compression piston back pressure sides; and a crank axle having at least one crank pin, the at least two compression pistons being connected to a common one of said crank pins of said crank axle and located on opposite sides of said crank axle, said diaphragm of the two compression pistons changing the volumetric capacity of the piston back pressure sides 180° out of phase relative to one another.

2. The driving apparatus for a Stirling cycle engine according to claim 1, wherein said two compression pistons are arranged on one straight line intersecting at right angles with a central line of said crank angle.

3. The driving apparatus for a Stirling cycle engine according to claim 1, wherein the means for releasing pressure comprises a communicating pressure for communicating the spaces of the back pressure sides of said two compression pistons.

4. The driving apparatus for a Stirling cycle engine according to claim 1, wherein said compression pistons are separately arranged on opposite sides of said crank axle 180° out of phase relative to one another and are operatively connected to each other through said crank pin.

5. The driving apparatus for a Stirling cycle engine according to claim 1, wherein said two compression pistons are arranged along two parallel straight lines intersecting at right angles with a central line of said crank axle.

6. The driving apparatus for a Stirling cycle engine according to claim 1, further comprising an expansion space communicating with said compression pistons.

7. The driving apparatus for a Stirling cycle engine according to claim 6, further comprising a cold regenerator in a line of communication between the compression pistons and the expansion space.

* * * * *